US009315876B2

(12) United States Patent
Okita et al.

(10) Patent No.: US 9,315,876 B2
(45) Date of Patent: Apr. 19, 2016

(54) PRESS-FORMED PRODUCT AND METHOD FOR PRODUCING SAME

(75) Inventors: Keisuke Okita, Kobe (JP); Junya Naitou, Kobe (JP); Shushi Ikeda, Nagoya (JP)

(73) Assignee: Kobe Steel, Ltd., Hyogo (JP)

( * ) Notice: Subject to any disclaimer, the term of this patent is extended or adjusted under 35 U.S.C. 154(b) by 426 days.

(21) Appl. No.: 13/876,832

(22) PCT Filed: Sep. 30, 2011

(86) PCT No.: PCT/JP2011/072672

§ 371 (c)(1), (2), (4) Date: Mar. 28, 2013

(87) PCT Pub. No.: WO2012/043837

PCT Pub. Date: Apr. 5, 2012

(65) Prior Publication Data

US 2013/0180635 A1 Jul. 18, 2013

(30) Foreign Application Priority Data

Sep. 30, 2010 (JP) ..... 2010-222943

(51) Int. Cl.
*C21D 8/00* (2006.01)
*B21D 22/20* (2006.01)
(Continued)

(52) U.S. Cl.
CPC ..... *C21D 8/005* (2013.01); *B21D 22/208* (2013.01); *C21D 1/18* (2013.01); *C21D 1/673* (2013.01); *C21D 9/48* (2013.01); *C21D 11/005* (2013.01); *C21D 2211/008* (2013.01)

(58) Field of Classification Search
CPC ..... B21D 22/208; C21D 1/18; C21D 1/673; C21D 8/005; C21D 11/005; C21D 2211/008; C21D 9/48
See application file for complete search history.

(56) References Cited

U.S. PATENT DOCUMENTS 7,137,201 B2 11/2006 Brodt et al.
7,559,998 B2 7/2009 Nishibata et al.
(Continued)

FOREIGN PATENT DOCUMENTS

CN 1698993 A 11/2005
CN 101619383 A 1/2010
(Continued)

OTHER PUBLICATIONS

International Search Report from the International Bureau, in corresponding International Application No. PCT/JP2011/072672, mailed Jan. 10, 2012, pp. 1-2 and Written Opinion of International Searching Authority, pp. 1-3.
(Continued)

*Primary Examiner* — Veronica F Faison
(74) *Attorney, Agent, or Firm* — Studebaker & Brackett PC

(57) ABSTRACT

There is provided a useful method for producing a press-formed product without causing disadvantages such as hardness variation, which product has favorable formability in a level so as to be able to be produced by deep drawing, and which method is carried out by heating a thin steel sheet to a temperature not lower than an $Ac_3$ transformation point thereof; and then cooling the thin steel sheet at a rate not lower than a critical cooling rate, during which the thin steel sheet is formed into the press-formed product, wherein the forming is started from a temperature higher than a martensitic transformation start temperature Ms thereof, the cooling rate is kept to be 10° C./sec. or higher during the forming, and the forming is finished in a temperature range not higher than the martensitic transformation start temperature Ms.

8 Claims, 4 Drawing Sheets

(51) Int. Cl.

| | |
|---|---|
| ***C21D 1/18*** | (2006.01) |
| ***C21D 1/673*** | (2006.01) |
| ***C21D 9/48*** | (2006.01) |
| ***C21D 11/00*** | (2006.01) |

(56) References Cited

U.S. PATENT DOCUMENTS

| | | | | |
|---|---|---|---|---|
| 8,021,497 | B2 | 9/2011 | Fleischanderl et al. | |
| 2003/0129444 | A1 * | 7/2003 | Matsuoka et al. | 428/659 |
| 2004/0096352 | A1 * | 5/2004 | Ozaki et al. | 420/70 |
| 2005/0257862 | A1 | 11/2005 | Asai et al. | |
| 2006/0185774 | A1 | 8/2006 | Nishibata et al. | |
| 2013/0136945 | A1 * | 5/2013 | Charest et al. | 428/610 |
| 2014/0338802 | A1 * | 11/2014 | Okita et al. | 148/653 |

FOREIGN PATENT DOCUMENTS

| | | | |
|---|---|---|---|
| EP | 1642991 | A1 | 4/2006 |
| JP | 61-243127 | A | 10/1986 |
| JP | 2002-102980 | A | 4/2002 |
| JP | 2004-124221 | A | 4/2004 |
| JP | 2006-224162 | A | 8/2006 |
| JP | 2007-275937 | A | 10/2007 |

OTHER PUBLICATIONS

T. Kunitake, "Prediction of $Ac_1$, $Ac_3$ and Ms Transformation Points of Steel by Empirical Formulae", Heat Treatment, 41(3), 164-169, 2001, 2 pages.

* cited by examiner

PRESS-FORMED PRODUCT AND METHOD FOR PRODUCING SAME

TECHNICAL FIELD

The present invention pertains to the filed of producing thin steel sheet formed products to be applied mainly to automobile bodies, and more specifically, the present invention relates to a method for producing press-formed products by heating a steel sheet (blank) as their material to a temperature not lower than an austenite temperature ($Ac_3$ transformation point) thereof and then press-forming the steel sheet into a prescribed shape, in which the steel sheet can be given the shape and at the same time hardened to have prescribed hardness, as well as to press-formed products and others obtained by such a production method. In particular, the present invention relates to a method for producing press-formed products, which makes it possible to achieve favorable forming without causing fracture, crack, or any other defects during the press-forming, as well as to press-formed products and others.

BACKGROUND ART

From the viewpoint of global environment protection, automobile lightening has strongly been desired for the purpose of making fuel-efficient automobiles. When a steel sheet is used for parts composing a vehicle, lightening has been attempted by applying a high-strength steel sheet and reducing the sheet thickness of this steel sheet. On the other hand, to improve the collision safety of automobiles, further strengthening has been required for automobile parts, such as pillars, and there has been an increasing need for ultrahigh-strength steel sheets having higher tensile strength.

However, when thin steel sheets are made to have higher strength, the elongation EL or r value (Lankford value) thereof is lowered, resulting in the deterioration of press formability or shape fixability.

Under these circumstances, to realize high-strength structural parts for automobiles, a hot pressing method (a so-called "hot press method") has been proposed (e.g., Patent Document 1), in which both press-forming and improving the strength of parts by hardening are achieved at the same time. This technique is a method in which a steel sheet is heated up to an austenite (γ) region not lower than an $Ac_3$ transformation point thereof and then hot press-formed, during which the steel sheet is simultaneously hardened by being brought into contact with a press tool at ordinary temperature, to realize ultrahigh strengthening.

According to such a hot pressing method, the steel sheet is formed in a state of low strength, and therefore, the steel sheet exhibits decreased springback (favorable shape fixability), resulting in the achievement of a tensile strength in the 1500 MPa class by rapid cooling. In this regard, such a hot pressing method has been called with various names, in addition to a hot press method, such as a hot forming method, a hot stamping method, a hot stamp method, and a die quenching method.

FIG. 1 is a schematic explanatory view showing the structure of a press tool for carrying out hot press-forming as described above (hereinafter represented sometimes by "hot pressing"). In FIG. 1, reference numerals 1, 2, 3, and 4 represent a punch, a die, a blank holder, and a steel sheet (blank), respectively, and abbreviations BHF, rp, rd, and CL represent a blank holding force, a punch shoulder radius, a die shoulder radius, and a clearance between the punch and the die, respectively. In these parts, punch 1 and die 2 have passage 1*a* and passage 2*a*, respectively, formed in the inside thereof, through which passages a cooling medium (e.g., water) can be allowed to pass, and the press tool is made to have such a structure that these members can be cooled by allowing the cooling medium to pass through these passages.

When a steel sheet is hot pressed (e.g., subjected to hot deep drawing) with such a press tool, the forming is started in a state where a blank (steel sheet 4) is softened by heating to a temperature not lower than an $Ac_3$ transformation point thereof. That is, steel sheet 4 is pushed into a cavity of die 2 (between the parts indicated by reference numerals 2 and 2 in FIG. 1) by punch 1 with steel sheet 4 in a high-temperature state being sandwiched between die 2 and blank holder 3 to form steel sheet 4 into a shape corresponding to the outer shape of punch 1 while reducing the outer diameter of steel sheet 4. In addition, heat is removed from steel sheet 4 to the press tool (punch 1 and die 2) by cooling punch 1 and die 2 in parallel with the forming, and the hardening of a material is carried out by further retaining and cooling steel sheet 4 at the lower dead point in the forming (the point of time when the punch head is positioned at the highest level: the state shown in FIG. 1). Formed products with high dimension accuracy and strength in the 1500 MPa class can be obtained by carrying out such a forming method. Furthermore, such a forming method results in that the volume of a pressing machine can be made smaller because a forming load can be reduced as compared with the case where parts in the same strength class are formed by cold pressing.

PRIOR ART DOCUMENTS

Patent Documents

Patent Document 1: Japanese Patent Laid-open Publication (Kokai) No. 2002-102980

SUMMARY OF THE INVENTION

Problems to be Solved by the Invention

In the conventional hot pressing, a steel sheet is heated up to an austenitic region (e.g., about 900° C.) not lower than an $Ac_3$ transformation point thereof, and the steel sheet is then cooled by a press tool for press-forming while being kept in a high-temperature state. Therefore, the steel sheet may easily have a temperature difference between its portion coming into contact with, and its portion not coming into contact with, the press tool composed of a punch and a die, so that strain may be concentrated on its portion becoming relatively high temperature, or so that, for example, in deep drawing, a shrink flange becomes unshrinkable by cooling, both resulting in the deterioration of formability, and in particular, thereby making it difficult to achieve deep drawing.

In view of such problems, a so-called indirect method has been proposed, in which a steel sheet is formed into a near net (in a state close to a formed product) by cold pressing and the near net is then heated and die-quenched. This method, however, has a defect that the forming time is lengthened because of its increased forming steps. Therefore, presently there has been a demand for some technique in which deep drawing can be made by the so-called direct method not including so many forming steps.

Furthermore, in the hot pressing, a steel sheet is cooled while being press-formed with a press tool, and therefore, the cooling rate may vary in the blank depending on the state of its contact with the press tool. This may cause a variation in the hardness distribution (uneven hardening) of a portion that has undergone hot pressing, resulting in a problem in quality.

The present invention has been made in view of the above-described circumstances, and its object is to provide a method for producing a useful method for producing press-formed products without causing disadvantages such as hardness variation, which products have favorable formability in a level so as to be able to be produced by deep drawing, as well as press-formed products obtained by such a production method.

Means for Solving the Problems

The method of the present invention for producing a press-formed product, which method was able to achieve the object described above, is characterized in that when a formed product is produced by press-forming a thin steel sheet with a punch and a die, the thin steel sheet is heated to a temperature not lower than an $Ac_3$ transformation point of the this steel sheet, and the thin steel sheet is then cooled at a rate not lower than a critical cooling rate, during which the thin steel sheet is formed into the formed product, wherein the forming is started from a temperature higher than a martensitic transformation start temperature Ms thereof, the cooling rate is kept to be 10° C./sec. or higher during the forming, and the forming is finished in a temperature range not higher than the martensitic transformation start temperature Ms.

In the method of the present invention, when the thin steel sheet is cooled before the start of the forming, there may be adopted, for example, a) gas-jet cooling or b) bringing the thin steel sheet into contact with a cooled metal roll. In addition, the cooling rate of the thin steel sheet before the start of the forming may be 25° C./sec. or higher. Furthermore, the cooling rate during the forming may preferably be 30° C./sec. or higher.

The finish temperature of the forming may preferably be set to a temperature higher than a martensitic transformation finish temperature Mf thereof. In addition, the method of the present invention is particularly effective when the forming is carried by drawing with a blank holder. Even if such a forming method is adopted, favorable formability can be secured without causing fracture or crack. The press-formed product obtained by the method of the present invention may have a Vickers hardness Hv of 450 or higher.

Effect of the Invention

According to the present invention, it became possible the production of press-formed products in high productivity without causing fracture, crack, or any other defects during the forming because a steel sheet is cooled at a rate not lower than a critical cooling rate, during which the steel sheet is formed into the formed product, wherein the forming is started from a temperature higher than a martensitic transformation start temperature Ms thereof, the cooling rate is kept to a prescribed cooling rate during the forming, and the forming is finished in a temperature range not higher than the martensitic transformation start temperature Ms.

MODE FOR CARRYING OUT THE INVENTION

Figure 1:
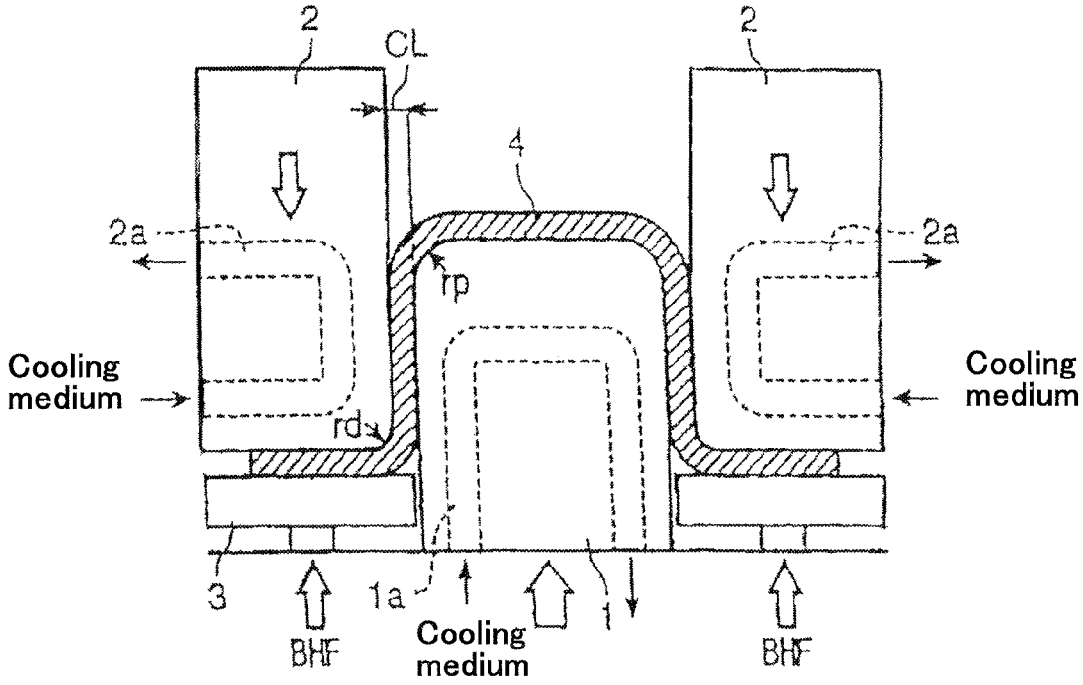
FIG. 1 is a schematic explanatory view showing the structure of a press tool for carrying out hot press-forming.

The present inventors have studied from various angles to produce press-formed products having favorable formability without causing disadvantages such as hardness variation when a thin steel sheet is heated to a temperature not lower than an $Ac_3$ transformation point thereof and then press-formed As a result, they have found that favorable formability can be secured without causing disadvantages such as hardness variation, if a thin steel sheet is heated to a temperature not lower than an $Ac_3$ transformation point thereof, and then press-forming is not immediately started, but the thin steel sheet is cooled at a rate not lower than a critical cooling rate, during which the thin steel sheet is formed into the formed product, wherein the press-forming is started from a temperature higher than a martensitic transformation start temperature Ms thereof, the cooling rate is kept to a prescribed cooling rate during the forming, and the forming is finished in a temperature range not higher than the martensitic transformation start temperature Ms, thereby completing the present invention. The following will specifically explain the present invention along the background of how the present invention has been completed.

The present inventors have made a square tube drawing experiment in which a steel sheet with a chemical element composition shown in Table 1 below is first heated to 900° C. (this steel sheet has an $Ac_3$ transformation point of 830° C., a martensitic transformation start temperature Ms of 411° C., and a martensitic transformation finish temperature Mf of 261° C.) and then subjected to square cup drawing by the above-described procedure with a press tool shown in FIG. 1 above. As a result, they have found that it becomes possible to achieve favorable formability and therefore to make deep drawing to the lower dead point in the forming, if the steel sheet is rapidly cooled after the heating as described above, during which the forming is started at a temperature not lower than the martensitic transformation start temperature Ms and the forming is finished in a temperature range not higher than the martensitic transformation start temperature Ms.

TABLE 1

| Chemical element composition (wt %) of blank* | | | | | | | | | | | |
|---|---|---|---|---|---|---|---|---|---|---|---|
| C | Si | Mn | P | S | Cu | Al | Ni | Cr | Ti | B | N |
| 0.23 | 0.18 | 1.28 | 0.013 | 0.002 | 0.08 | 0.041 | 0.01 | 0.21 | 0.023 | 0.0029 | 0.0041 |

*Remainder: iron and unavoidable impurities other than P, S, and N

The $Ac_3$ transformation point described above means an austenite transformation completion temperature $Ac_3$ when a steel sheet is heated, and it can be calculated by formula (1) below. In addition, the martensitic transformation start temperature Ms and martensitic transformation finish temperature Mf are values calculated by formulae (2) and (3), respectively (see, e.g., "Heat Treatment," 41(3), 164-169, 2001, Tatsuro KUNITAKE, "Prediction of $Ac_1$, $Ac_3$, and Ms Transformation Points of Steel by Empirical Formulae").

$$Ac_3 \text{ transformation point } (^\circ \text{ C.}) = -230.5\times[C]+31.6\times[Si]-20.4\times[Mn]-39.8\times[Cu]-18.1\times[Ni]-14.8\times[Cr]+16.8\times[Mo]+912 \quad (1)$$

$$Ms(^\circ \text{ C.}) = 560.5-\{407.3\times[C]+7.3\times[Si]+37.8\times[Mn]+20.5\times[Cu]+19.5\times[Ni]+19.8[Cr]+4.5\times[Mo]\} \quad (2)$$

$$Mf(^\circ \text{ C.}) = Ms-150.0 \quad (3)$$

where [C], [Si], [Mn], [Cu], [Ni], [Cr], and [Mo] indicate C, Si, Mn, Cu, Ni, Cr, and Mo contents (wt %), respectively.

Figure 2:
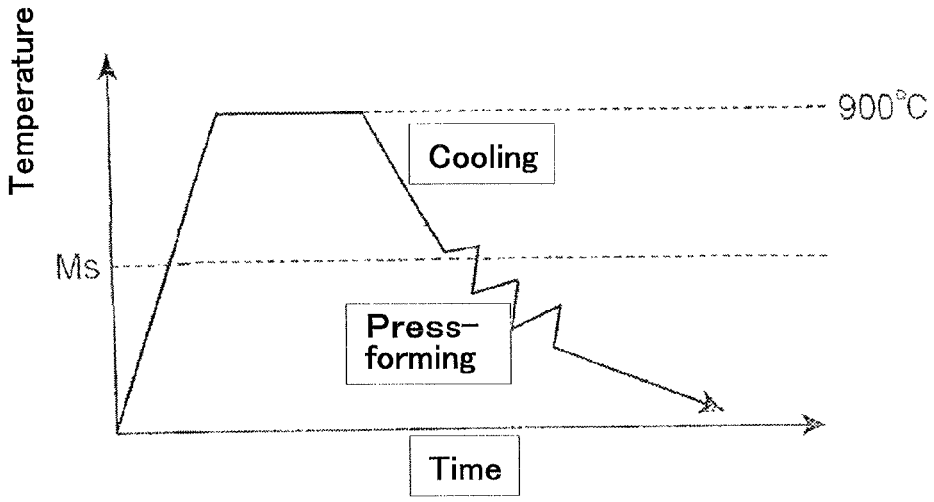
FIG. 2 is a graph showing an example of the heat-treatment pattern when the method of the present invention is carried out.

FIG. 2 shows a heat-treatment pattern when a steel sheet is heated to 900° C. and then rapidly cooled, during which forming is started at a temperature higher than a martensitic transformation start temperature Ms thereof. This heat-treatment pattern corresponds to one when the method of the present invention is carried out. As shown in FIG. 2, a thin steel sheet is heated to a temperature not lower than a $Ac_3$ transformation point thereof and then rapidly cooled down to a temperature higher than a martensitic transformation start temperature Ms of the this steel sheet, after which forming is started from that temperature and the forming is finished in a temperature range not higher than the martensitic transformation start temperature Ms, resulting in the achievement of favorable formability.

In the convention hot forming, it has been considered as the common general technical knowledge to start the forming at as high a temperature as possible. In contrast, a steel sheet is once heated and then rapidly cooled down to a temperature higher than a martensitic transformation start temperature Ms thereof at a rate not lower than a critical cooling rate to put it into a state liable to cause martensitic transformation, after which press-forming is started and the forming is finished in a temperature range not higher than the martensitic transformation start temperature Ms, resulting in the improvement of drawing formability. This seems to be because the occurrence of martensitic transformation during the press-forming causes transformation plasticity phenomenon to make deformation strain small.

Figure 3:
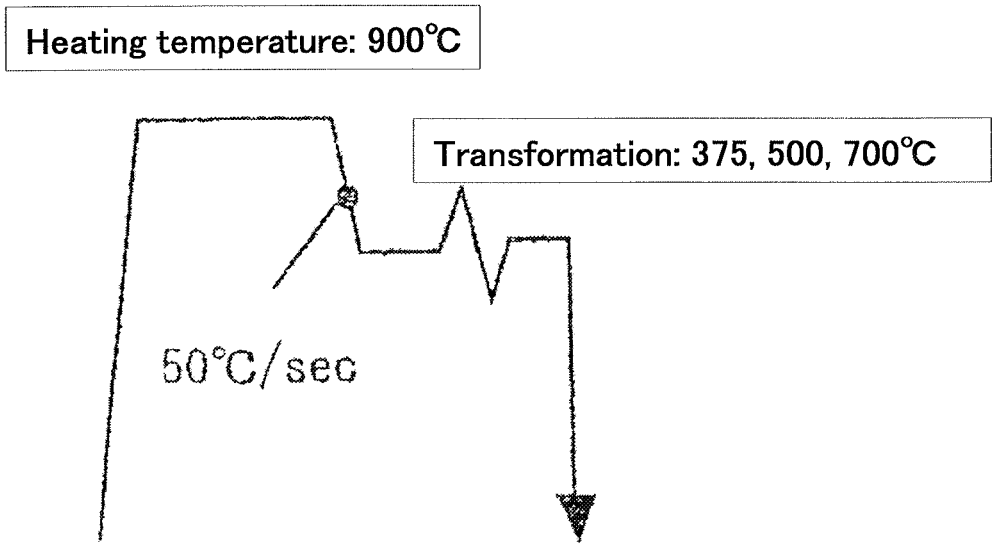
FIG. 3 is a graph showing a heat-treatment pattern in the simulation for studying deformation behavior.

To clarify the mechanism of the present invention, the following simulations (tensile tests) were carried out to study the influence of martensitic transformation on deformation behavior in the deformation process. The heat-treatment pattern at that time is shown in FIG. 3. That is, the heating temperature of a steel sheet was set to be 900° C., and the steel sheet was rapidly cooled to a prescribed temperature (700° C., 500° C., or 375° C.) at a cooling rate of 50° C. sec., at which each prescribed temperature a tensile test was carried out. In this regard, the structure of the steel sheet is in the supercooled austenite phase at a prescribed temperature of 700° C. or 500° C. or in a two-phase region made of the supercooled austenite phase and the martensitic phase at a prescribed temperature of 375° C.

Figure 4:
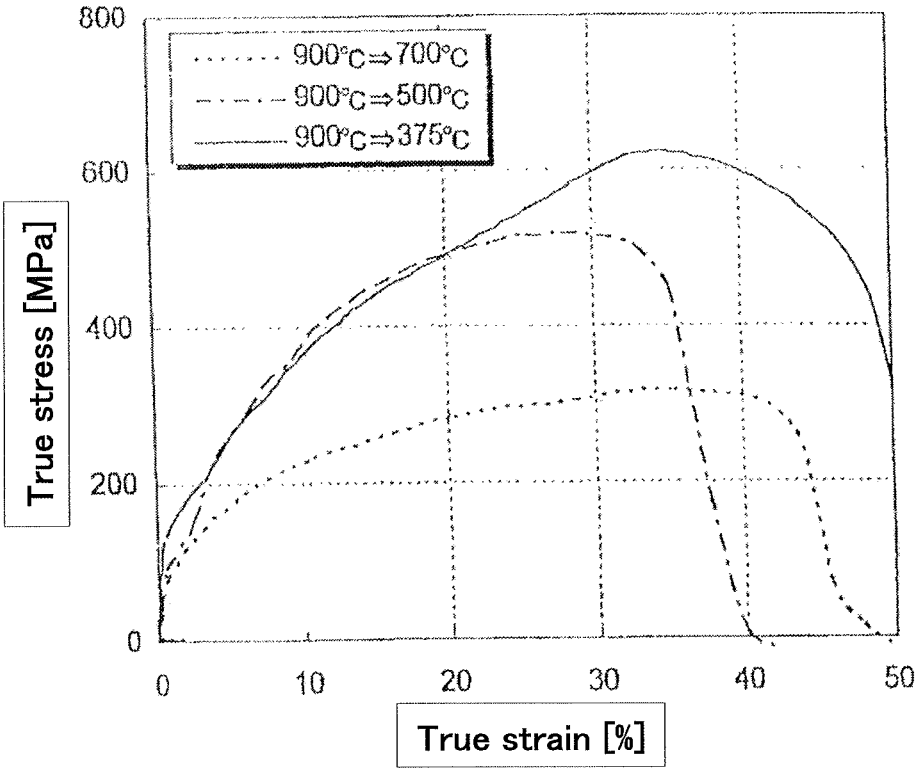
FIG. 4 is a stress-strain curve in the simulation for studying deformation behavior.

As shown in FIG. 4 (stress-strain curve), deformation behaviors from 500° C. to 375° C. are very similar in the additional strain range up to 20%. That is, when a blank is hot pressed in this temperature range, the blank shows similar deformation behavior, even if temperature distribution occurs in the blank, and therefore, the blank becomes a uniform material from the viewpoint of material strength, thereby making it possible to assume that formability is improved. In addition, work hardening in the deformation behavior at 500° C. or 375° C. becomes greater than that in the deformation behavior at 700° C. In general, it is known that greater work hardening, i.e., a higher n value (work hardening coefficient), provides more favorable formability. Furthermore, the greatest elongation (ductibility) is obtained at 375° C., at which temperature martensitic transformation has occurred. The precise cause of this greatest elongation is as yet not well known, but it seems to be responsible for structure change caused by phase transformation, such as deformation plasticity phenomenon.

When press-forming is carried out under the conditions as described above, mechanical material characteristics during the press-forming become uniform material strength, while keeping a high n value, and material ductibility can also be secured; therefore, deep drawing formability can also be improved. In addition, the press-forming start temperature can also be set to a relatively low temperature, so that holding time at the lower dead point in the forming can be shortened, thereby making it possible to improve productivity.

The method of the present invention applies the fundamentals that a steel sheet is heated up to a temperature not lower than an $Ac_3$ transformation point thereof and then rapidly cooled down to a prescribed temperature whereby the steel sheet is put into a state liable to cause martensitic transformation before forming and make effective progress in the martensitic transformation during the forming. To allow the steel sheet to exhibit such an effect, the cooling rate after heating up to a temperature not lower than the $Ac_3$ transformation point should be set to a rate (25° C./sec. or higher for the steel sheet shown in Table 1) not lower than a critical cooling rate (i.e., lower critical cooling rate). That is, depending on the kind of steel, when the cooling rate becomes lower than the critical cooling rate, martensitic transformation itself hardly occurs and it becomes difficult to effectively exhibit the effect (press formability improvement effect) due to martensitic transformation. In addition, the upper limit of the cooling rate during the rapid cooling is not particularly limited, but it may preferably be set to be 450°/sec. or lower from the viewpoint of securement of temperature uniformity in the blank.

To secure favorable formability by allowing the steel sheet to cause martensitic transformation during the forming, the cooling rate should be secured to be 10° C./sec. or higher, more preferably 30° C./sec. or higher, even during the forming.

Figure 5:
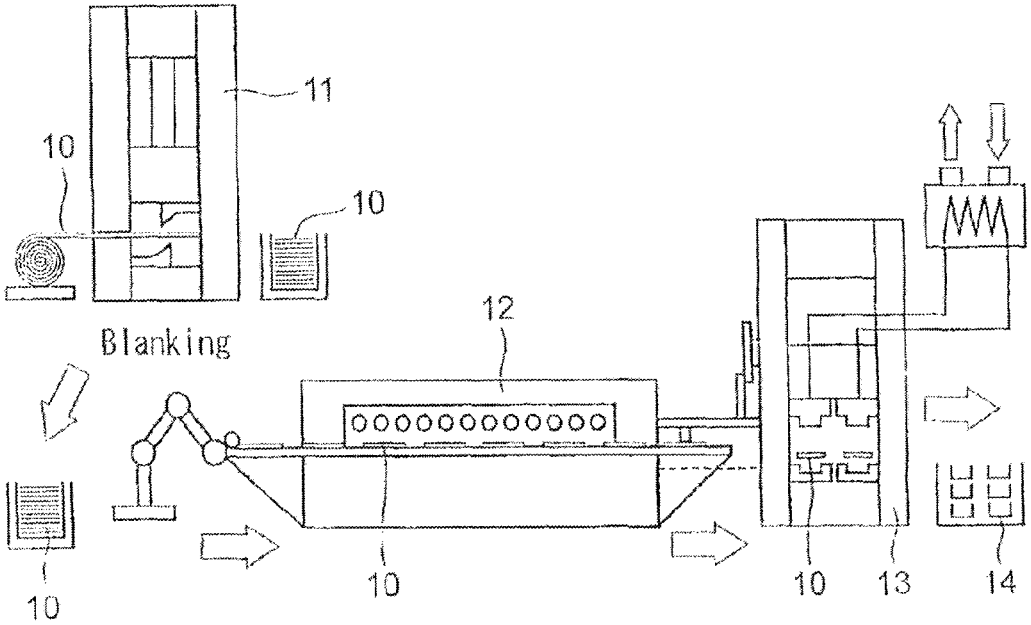
FIG. 5 is a schematic explanatory view showing an example of the conventional hot press line (equipment structure).

By the way, the conventional hot press line (equipment structure) generally has a structure as shown in FIG. 5 (schematic explanatory view). That is, as shown in FIG. 5, coil-shaped steel sheet 10 is cut out with blanking machine 11 (blanking), and the blank is heated in heating oven 12 and moved to press-forming machine 12, in which the blank is formed into press-formed product 14.

Figure 6:
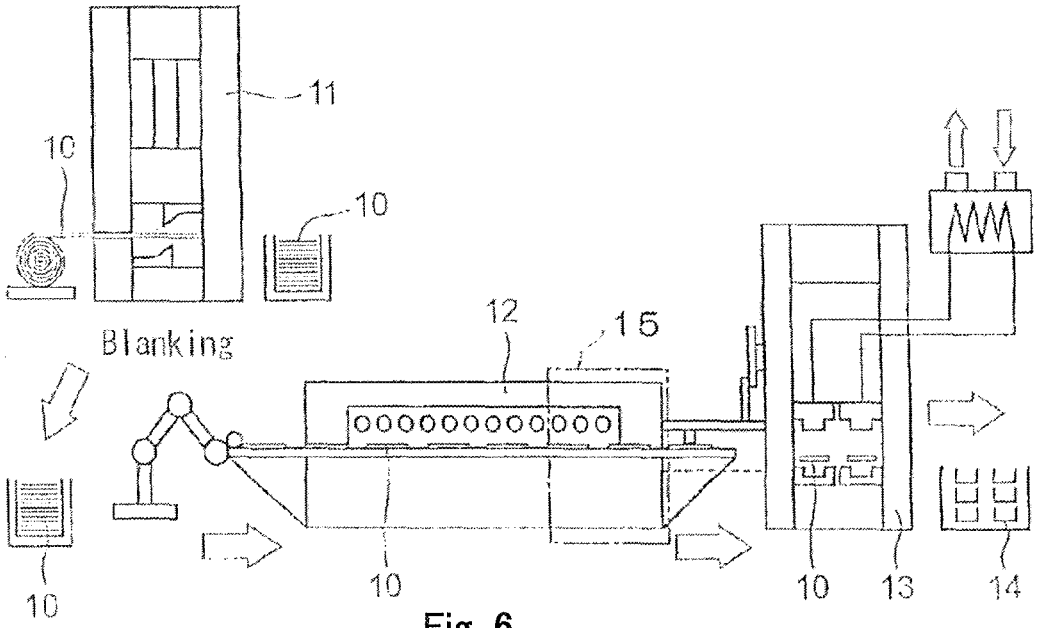
FIG. 6 is a schematic explanatory view showing an example of the press line (equipment structure) for carrying out the method of the present invention.

In the present invention, a thin steel sheet is heated to a temperature not lower than an $Ac_3$ transformation point thereof, and then the forming is not immediately started, but the thin steel sheet is rapidly cooled down to a temperature higher than a martensitic transformation start temperature Ms thereof, so that the thin steel sheet is put into a state liable to cause martensitic transformation, after which press-forming is started. When such cooling is carried out, an equipment structure may be adopted, such as shown in FIG. 6 (schematic explanatory view). That is, cooling zone 15 is disposed in the latter half region of heating oven 12 (the same reference numerals are assigned to the same parts in FIGS. 5 and 6), and steel sheet 10 is moved from heating oven 12 to press-forming machine 13, during which steel sheet 10 may be cooled in cooling zone 15. The cooling carried out in cooling zone 15 can include cooling carried out by a method, such as described in (1) to (4) below, in addition to the method described above.

(1) Gas-jet cooling is carried out with a gas cooling means.

(2) Heat is removed with a means for bringing the steel sheet into contact with a metal as a cooling medium (e.g., water-cooled metal roll).

(3) Cooling is carried out with a mist cooling means.

(4) Cooling is carried out with a dry ice shot means (the blank material is cooled by allowing dry ice granules to impinge thereon).

The steel sheet is cooled down to a prescribed temperature in cooling zone 15 as described above and then moved to press-forming machine 13, in which the steel sheet may be formed, while being cooled with a press tool, subsequently to the start of the forming.

When the method of the present invention is carried out, a thin steel sheet should first be heated to a temperature not lower than an $Ac_3$ transformation point thereof. The upper limit of the heating temperature may preferably not be allowed to exceed approximately 1000° C. When the heating temperature becomes higher than 1000° C., the formation of oxide scales becomes significant (e.g., 100 μm or greater), and therefore, formed products (after descaling) are likely to have smaller sheet thickness than the prescribed one.

In the present invention, the forming should be started from a temperature higher than a martensitic transformation start temperature Ms of a steel sheet, and the forming should be finished in a temperature range not higher than the martensitic transformation start temperature Ms. With respect to the forming finish temperature, since formability rather becomes worse, if martensitic transformation is completely finished during the forming, this temperature (forming finish temperature) may preferably be set to a temperature higher than a martensitic transformation finish temperature Mf thereof.

The method of the present invention can achieve the above-described object by appropriately controlling the forming start temperature, forming finish temperature, and cooling rates (before forming and during the forming). Such an effect becomes prominently exhibited when formed products having complicated shapes are formed (i.e., formed by deep drawing) with a press tool having a blank holder. In this regard, however, the method of the present invention is not limited to drawing with a blank holder, but includes the case where ordinary press-forming (e.g., stretch forming) is carried out, and the effect of the present invention can be achieved even in the case where formed products are produced by such a method.

The following will describe the present invention in detail by way of Examples, but the present invention is not limited to the Examples described below. The present invention can be put into practice after appropriate modifications or variations within a range capable of meeting the gist described above and below, all of which are included in the technical scope of the present invention.

EXAMPLES

Steel with a chemical element composition shown in Table 1 above was cold-rolled to have a thickness of 1.4 mm by an ordinary means. This steel sheet was punched out into round blanks having diameters (blank diameters) of from 90 mm to 110 mm for experiments (therefore, these blanks had an $Ac_3$ transformation point of 830° C., a martensitic transformation start temperature Ms of 411° C., and a martensitic transformation finish temperature Mf of 261° C.).

The round blanks were subjected to square cup drawing with a press tool, in which the head shape of a punch was square (45 mm on a side), (i.e., a square cup die and a square cup punch), (see FIG. 1 above), according to the method of the present invention. At that time, the blanks were heated in air with an electric oven, the heating temperature of which was set to be 900° C.

The forming experiments were carried out with a press tool shown in FIG. 1 above, which was placed in a crank press machine. The forming start temperature (pressing start temperature) was set to be 760° C., 720° C., 650° C., 620° C., 580° C., 520° C., 470° C., 440° C., or 415° C. To study the influence of martensitic transformation on formability, the experiments were carried out by controlling the forming time (i.e., time from the contact of the press tool with the blank to the stop of the press tool at the lower dead point in the forming) in such a manner that the blanks came to have temperatures higher than, or not higher than, the martensitic transformation start temperature Ms, after the finish of the forming. The experimental conditions are shown in Table 2 below.

In experiments Nos. 1 to 7, the forming time was set in such a manner that the blanks came to have temperatures not higher than the martensitic transformation start temperature Ms after the finish of the forming. In experiments Nos. 8 to 17, the forming time was set in such a manner that the blanks came to have temperatures higher than the martensitic transformation start temperature Ms after the finish of the forming. The respective forming times (pressing times) were set on the basis of the cooling rate (50° C./sec.) of the press tool separately calculated. The blanks were cooled at a cooling rate of 25° C./sec. by blowing cold air from the heating temperature to the forming start temperature. The other press-forming conditions were as described below.

(The Other Press-Forming Conditions)

Blank holding force: 3 tons

Die shoulder radius rd: 5 mm

Punch shoulder radius rp: 5 mm

Clearance CL between punch and die: 1.32/2+1.4 (steel sheet thickness) mm

Forming height: 37 mm

TABLE 2

| Experiment No. | Pressing start temperature (° C.) | Forming finish temperature (° C.) | Pressing time (sec.) | Formable blank diameter (mm) |
|---|---|---|---|---|
| 1 | 580.0 | 405.0 | 3.50 | 110 |
| 2 | 520.0 | 405.0 | 2.30 | 110 |
| 3 | 470.0 | 405.0 | 1.30 | 110 |
| 4 | 470.0 | 355.0 | 2.30 | 110 |
| 5 | 440.0 | 402.5 | 0.75 | 110 |
| 6 | 440.0 | 375.0 | 1.30 | 110 |
| 7 | 415.0 | 377.5 | 0.75 | 110 |
| 8 | 760.0 | 722.5 | 0.75 | 90 |
| 9 | 720.0 | 682.5 | 0.75 | 90 |
| 10 | 650.0 | 612.5 | 0.75 | 95 |
| 11 | 620.0 | 582.5 | 0.75 | 95 |
| 12 | 580.0 | 542.5 | 0.75 | 95 |
| 13 | 580.0 | 515.0 | 1.30 | 95 |
| 14 | 580.0 | 465.0 | 2.30 | 95 |
| 15 | 520.0 | 482.5 | 0.75 | 100 |
| 16 | 520.0 | 455.0 | 1.30 | 100 |
| 17 | 470.0 | 432.5 | 0.75 | 100 |

The results are shown in Table 2. As can be seen from these results, it was confirmed that when the forming was started from a temperature higher than the martensitic transformation start temperature Ms and the forming was finished in a temperature range not higher than the martensitic transformation start temperature Ms (experiment Nos. 1 to 7), the forming was able to be made to a larger blank diameter (formable blank diameter) and favorable formability was exhibited.

Figure 7:
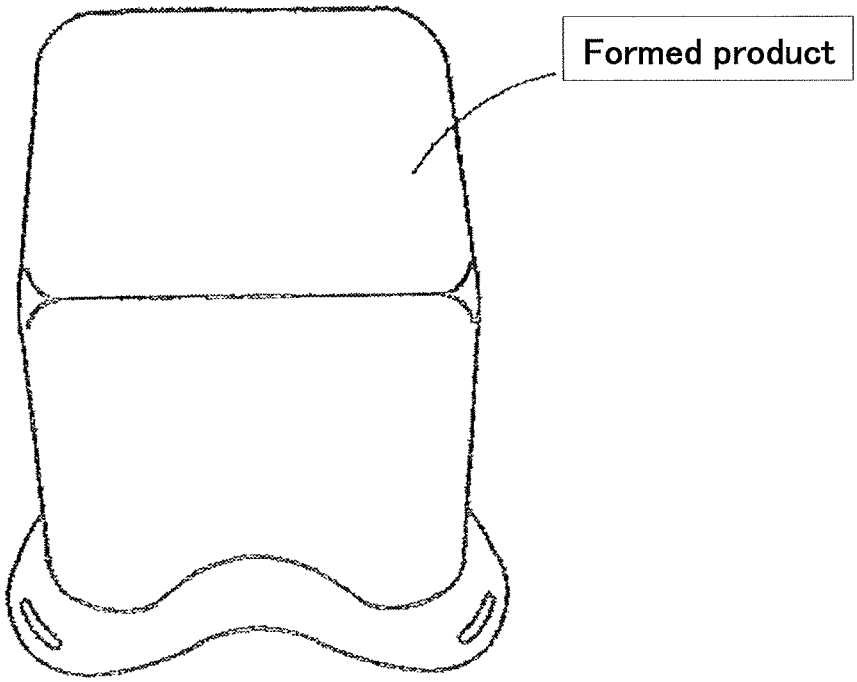
FIG. 7 is a perspective view schematically showing the appearance configuration of a formed product which could have undergone forming.

The appearance configuration of a formed product which could have undergone favorable forming is schematically shown in FIG. 7 (perspective view). The formed product had a Vickers hardness Hv of 450 or higher at any portion thereof. As can be seen from these results, the advantage of the present invention is indicated such that deep drawability can be improved by cooling down to a temperature higher than the martensitic transformation start temperature Ms, starting the forming from that temperature, and finishing the forming in a temperature range not higher than the martensitic transformation start temperature Ms.

INDUSTRIAL APPLICABILITY

The method of the present invention includes heating a thin steel sheet to a temperature not lower than an $Ac_3$ transformation point thereof and then cooling the thin steel sheet at a rate not lower than a critical cooling rate, during which the thin steel sheet is formed into a press-formed product, wherein the forming is started from a temperature higher than a martensitic transformation start temperature Ms thereof, the cooling rate is kept to be 10° C./sec. or higher during the forming, and the forming is finished in a temperature range not higher than the martensitic transformation start temperature Ms. Thus, the method of present invention makes it possible to produce press-formed products without causing disadvantages such as hardness variation, which product has favorable formability in a level so as to be able to be produced by deep drawing.

EXPLANATION OF NUMERALS

1 Punch
2 Die
3 Blank holder
4, 10 Blank (steel sheet)
11 Blanking machine
12 Heating oven
13 Press-forming machine
14 Press-formed product
15 Cooling zone

The invention claimed is:

1. A method for producing a formed product by press-forming a thin steel sheet with a punch and a die, comprising:

heating the thin steel sheet to a temperature not lower than an $Ac_3$ transformation point thereof; and then cooling the thin steel sheet at a rate not lower than a critical cooling rate; and thereafter starting forming a thin steel sheet into the formed product, wherein the forming is started from a temperature higher than a martensitic transformation start temperature Ms thereof, the cooling rate is kept to be 10° C./sec. or higher during the forming, and the forming is finished in a temperature range not higher than the martensitic transformation start temperature Ms.

2. The production method according to claim 1, wherein the thin steel sheet is gas-jet cooled before the start of the forming.

3. The production method according to claim 1, wherein the thin steel sheet is brought into contact with a cooled metal roll before the start of the forming.

4. The production method according to claim 1, wherein the cooling rate before the start of the forming is 25° C./sec. or higher.

5. The production method according to claim 1, wherein the cooling rate during the forming is 30° C./sec. or higher.

6. The production method according to claim 1, wherein the forming is finished at a temperature higher than a martensitic transformation finish temperature Mf thereof.

7. The production method according to claim 1, wherein the forming is carried out by drawing with a blank holder.

8. A press-formed product obtained by a production method as set forth in claim 1, having a Vickers hardness Hv of 450 or higher.

* * * * *